US005413424A

United States Patent [19]

Silverstein

[11] Patent Number: 5,413,424

[45] Date of Patent: May 9, 1995

[54] RIBBON CASSETTE INCLUDING AN INKING DEVICE

[76] Inventor: Irwin Silverstein, 3610 Yacht Club Dr., Unit 708, North Miami, Fla. 33180

[21] Appl. No.: 157,308

[22] Filed: Nov. 26, 1993

[30] Foreign Application Priority Data

Oct. 8, 1993 [BR] Brazil ..... 7301978 U

[51] Int. Cl.[6] ..... B41J 27/12

[52] U.S. Cl. ..... 400/202.4; 400/196.1; 400/208

[58] Field of Search ..... 400/197, 200, 201, 202, 400/202.4, 202.2, 202.3, 196.1, 208

[56] References Cited

U.S. PATENT DOCUMENTS 4,653,947 3/1987 Echols ..... 400/202.4

FOREIGN PATENT DOCUMENTS

| | | | |
|---|---|---|---|
| 3535876 | 4/1987 | Germany | 400/202.2 |
| 0229584 | 10/1986 | Japan | 400/202.2 |
| 0013376 | 1/1987 | Japan | 400/202.4 |
| 0234283 | 9/1989 | Japan | 400/202 |
| 0039983 | 2/1990 | Japan | 400/197 |
| 0007373 | 1/1991 | Japan | 400/202.4 |

*Primary Examiner*—Edgar S. Burr
*Assistant Examiner*—Christopher A. Bennett

[57] ABSTRACT

A ribbon casette comprises with a cartridge, an inking device with a contact roller which maintains the ribbon between itself and a drive roller. The inking device is kept under a tangential and perpendicular pressure with respect to the drive direction of the ribbon by a pressure spring and matable projections located on the inking device and channels located on the inside housing of the cartridge and its lid.

2 Claims, 1 Drawing Sheet

RIBBON CASSETTE INCLUDING AN INKING DEVICE

FIELD OF THE INVENTION

The present invention refers to printer ribbons for the computer industry and, more specifically, to high speed printer ribbons for computers.

BACKGROUND OF THE INVENTION

As is known, the ribbons for printers of the matrix type are one of the supplies for the computer industry that represent a high degree of consumption. This type of ribbon for printers comprises a ribbon with ink and it is enclosed in an adequate cartridge containing a sprocketed drive roller. This type of drive roller exhibited by the prior art does not permit high speed use of the printer ribbon at levels normally above 300 characters per second. Attempts at a higher speed with this type of drive roller causes ribbon jamming and tearing.

Further, the conventional sprocketed drive roller does not require an even application of the print ribbon's inking device as the sprockets assist in driving the ribbon through such a device. Thus, these inking devices are typically cantileverly pivoted in relation to the drive roller. While this system is effective for its intended purpose, it does not permit high speed ribbon cassette printing.

SUMMARY OF THE INVENTION

It is then the objective of the present invention to provide high speed ribbon for printers which is capable of eliminating for good the inconveniences mentioned above. This high speed printer ribbon comprises, basically, the incorporation of a tracked, fluctuating ink device kept under pressure through the use of a laminar spring against the drive roller of a traction, which comprises in part the ink supply.

BRIEF DESCRIPTION OF THE DRAWINGS

In order to have a better understanding of the innovation in question, it will be described below in relation to the annexed design, which illustrates.

DETAILED DESCRIPTION OF A PREFERRED EMBODIMENT

Figure 2:
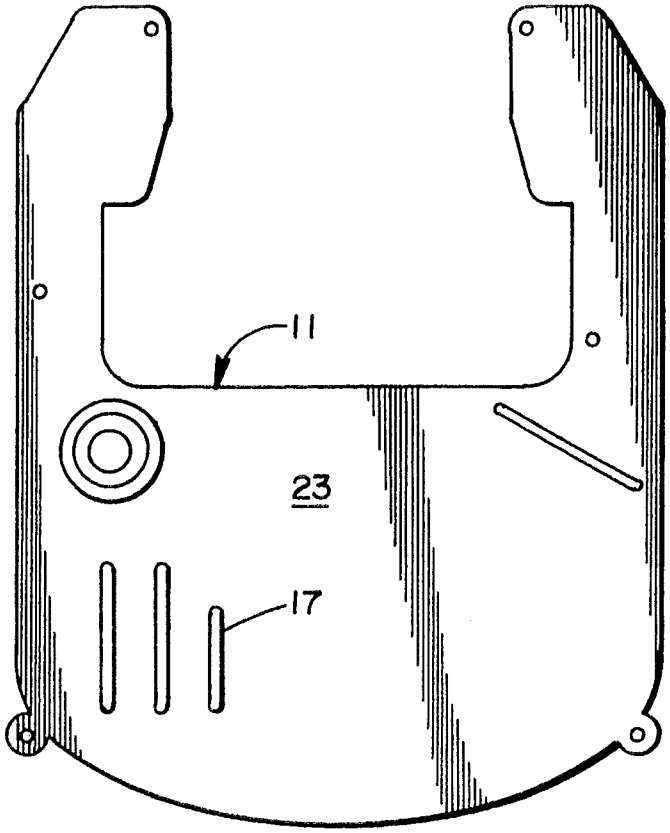
FIG. 2 is an inside plan view of the lid of the present invention.
Figure 1:
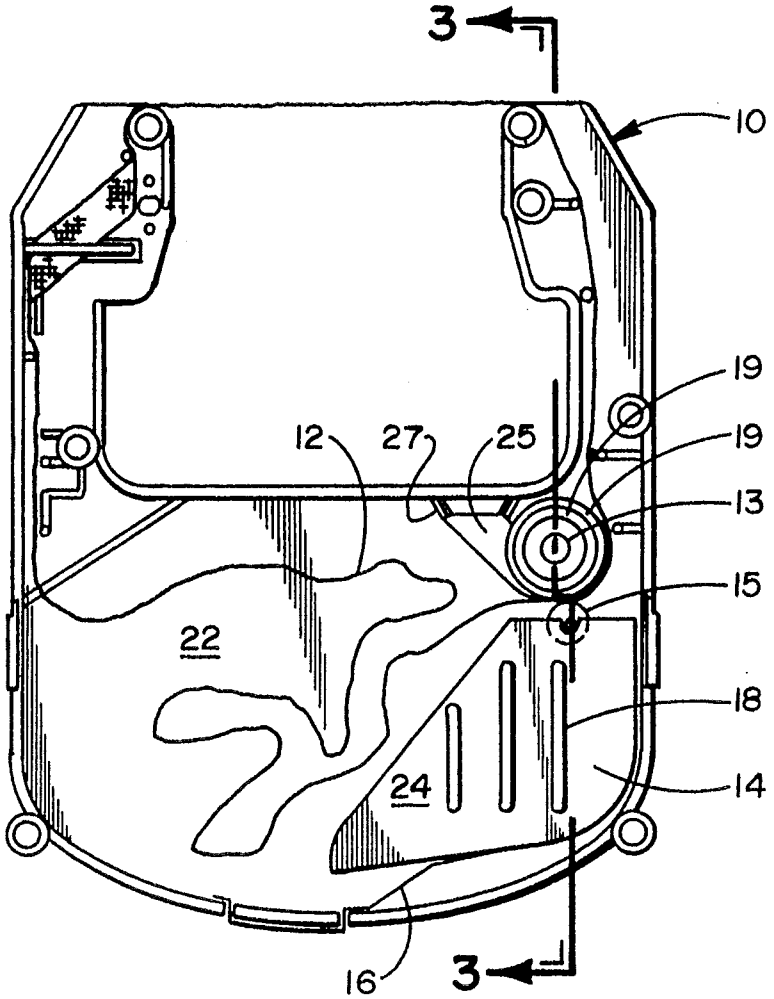
FIG. 1 is a plan view of the present invention in open position.

As illustrated in FIG. 1, a high speed ribbon for printers basically comprises one cartridge 10 with a lid 11. In this cartridge 10, an ink ribbon 12 runs, which is kept under traction by a drive roller of traction 13.

The cartridge 10 is kept in tangential and perpendicular contact with respect to its contact roller 15 and the ribbon 12 through the drive roller 13 by a track of projections 18, and matable channels 17 located on the inside housing 22 and 23 of the cartridge 10 and the lid 11, respectively. Three projections 18 each located on the top 24 of the inking device 14 and the bottom thereof (not shown) and corresponding, matable channels 17 are sufficient to keep the inking device 14 in the tangential and perpendicular relationship to the ribbon 12 direction as driven through by drive roller 13 when the lid 11 is secured to the cartridge 10.

The inking device 14 is maintained in its tangential and perpendicular relationship with the drive roller 13 by a pressure spring 16 which urges the inking device 14 along the mated projections 18 and channels 17 into contact with the ribbon 12 against the drive roller 13, again while the lid 11 is secured to the cartridge 10. The pressure spring 16 is interior of the cartridge 10 within its housing 22 but is affixed, in part, to the exterior of the housing 22 as well. This exterior placement of the base of the pressure spring 16 is necessary to permit it to have sufficient force to urge the inking device 14 into and against the ribbon 12.

It should be understood that the preferred embodiment of the present invention has been disclosed by way of example, and that other modifications may occur to those skilled in the art without departing from the scope and spirit of the appended claims.

What I claim is:

1. A high speed ribbon for printers comprising, a cartridge having an interior and exterior thereof;

a means for closure of said cartridge comprising a lid having channels therein;

an inked ribbon such that said ribbon runs through the interior of said cartridge;

a drive roller and a contact roller wherein said ribbon runs through said drive and contact rollers and is kept under traction thereby;

an inking device within the interior of said cartridge, and;

a means for urging said contact roller into and against the said drive roller tangentially and perpendicularly thereto, said urging means comprising a plurality of matable projections with said channels which result in a track to position the said inking device and contact roller into and against the said drive roller when the said lid is secured onto the said cartridge.

2. In the high speed ribbon for printers of claim 1, said urging means further comprises a spring for driving the said inking device into and against the said drive roller along the said track of matable projections and channels.

* * * * *